United States Patent [19]

Spengel, Sr.

[11] Patent Number: 4,565,292

[45] Date of Patent: Jan. 21, 1986

[54] CARGO HANDLING APPARATUS WITH A CARGO BOOM WHICH CAN BE SWUNG IN A SWIVEL BEARING BETWEEN TWO KINGPOSTS

[75] Inventor: Heinz F. J. Spengel, Sr., Hamburg, Fed. Rep. of Germany

[73] Assignee: Blohm & Voss AG, Hamburg, Fed. Rep. of Germany

[21] Appl. No.: 700,332

[22] PCT Filed: Jan. 23, 1981

[86] PCT No.: PCT/EP81/00008

§ 371 Date: Sep. 21, 1981

§ 102(e) Date: Sep. 21, 1981

[87] PCT Pub. No.: WO81/02152

PCT Pub. Date: Aug. 6, 1981

Related U.S. Application Data

[63] Continuation of Ser. No. 306,922, Sep. 21, 1981, abandoned.

[30] Foreign Application Priority Data

Jan. 24, 1980 [DE] Fed. Rep. of Germany ..... 3002464

[51] Int. Cl.[4] ..... B66C 23/06; B66C 23/52

[52] U.S. Cl. ..... 212/232; 212/191

[58] Field of Search ..... 212/177, 188, 190–195, 212/211, 223, 227, 230–232, 235, 245, 256, 264, 267

[56] References Cited

U.S. PATENT DOCUMENTS

| | | | |
|---|---|---|---|
| 964,534 | 7/1910 | McGiffert | 212/265 |
| 2,515,777 | 7/1950 | King et al. | 212/264 |
| 2,902,177 | 9/1959 | Stoddard et al. | 212/192 |
| 2,947,516 | 8/1960 | Jackson | 212/239 |
| 3,107,790 | 10/1963 | Lehmann | 212/193 |
| 3,125,227 | 3/1964 | Kauffman et al. | 212/187 |
| 3,236,390 | 2/1966 | Sprengel | 212/193 |

FOREIGN PATENT DOCUMENTS

| | | | |
|---|---|---|---|
| 1285222 | 1/1962 | France | 212/190 |
| 295774 | 5/1965 | Netherlands | 212/190 |
| 6603426 | 9/1966 | Netherlands | 212/190 |
| 937115 | 9/1963 | United Kingdom | 212/190 |

*Primary Examiner*—Trygve M. Blix
*Assistant Examiner*—R. B. Johnson

[57] ABSTRACT

In cargo handling apparatus with a cargo boom which can be swung between two kingposts, in which the cargo boom is provided at its upper end with an extension 1 which projects beyond the fittings of the main hoist, with a block fitting 2 for an auxiliary hoist being attached to the extension and with the auxiliary hoist being so rotatably arranged around the cargo boom axis that the lower edge of the auxiliary hoist cargo hook is free of the fittings of the main hoist with an approximately vertical position of the cargo boom, a block fitting 12 connected, fixedly or for only limited rotational movement, by means of a second extension 11 of the cargo boom with the block fitting of the first auxiliary hoist and is so arranged that, with the lower cargo block 15 in the raised position and with an approximately vertical position of the cargo boom, the lower side of the cargo hook of the second auxiliary hoist is also free of the block fitting of the first auxiliary hoist.

3 Claims, 4 Drawing Figures

CARGO HANDLING APPARATUS WITH A CARGO BOOM WHICH CAN BE SWUNG IN A SWIVEL BEARING BETWEEN TWO KINGPOSTS

This application is a continuation of application Ser. No. 306,922, filed Sept. 21,1981 now abandoned.

The invention relates to a cargo handling apparatus with a cargo boom which can be swung in a swivel bearing between two kingposts. Such cargo handling apparatus are well known in the art, for instance from U.S. Pat Nos. 2,914,193; 3,236,390 and 3,107,790. More specifically, the invention relates to a cargo handling apparatus of this type which carries an auxiliary hoist at the upper end of an extension which projects beyond the fittings of the main hoist. The block fitting of the auxiliary hoist which carries the upper cargo block and the guide sheave is rotatable about the axis of the cargo boom, and the guide sheave and the cable sheaves of the upper cargo block are arranged on the block fitting eccentrically of the axis of rotation thereof. The spacing of the block fitting of the auxiliary hoist from the fittings of the main hoist is at least sufficiently large so that, with the lower cargo block and cargo hook of the auxiliary hoist moved into the raised position and with an approximately vertical position of the cargo boom, the lower edge of the cargo hook is free of the fittings of the main hoist. Such a cargo handling apparatus is described for instance in German Patent Publication No. 2811384, published Sept. 20, 1979.

With cargo handling apparatus of the above described kind it is however often desirable for crane work, and in particular also for floating cranes operating off-shore, to have available, in addition to the main hoist and an auxiliary hoist, a further or second auxiliary hoist even though this may only be required for smaller loads.

The problem underlying the invention is to provide assistance in this aspect.

In order to solve this problem, in cargo handling apparatus of the above type a block fitting of a second auxiliary hoist is connected, fixedly or for only limited rotational movement, by means of a second extension of the cargo boom with the block fitting of the first auxiliary hoist which is rotatable about the axis of the cargo boom. Also, with the lower cargo block and the cargo hook moved into the raised position and an approximately vertical position of the cargo boom, the lower side of the cargo hook of the second auxiliary hoist is preferably free of the block fitting of the first auxiliary hoist.

This connection, in accordance with the invention, of the block fitting of the second auxiliary hoist with the block fitting of the first auxiliary hoist means that the second auxiliary hoist is necessarily turned together with the first auxiliary hoist, when the first auxiliary hoist rotates through approximately 180° to the other working region as the cargo boom is swung through the plane of the kingposts, so that the second auxiliary hoist likewise hangs free for operation over the other working region.

In a further development of the invention the block fitting of the second auxiliary hoist can make restricted rotational movements through an angle of approximately ±15° about the axis of the second cargo boom extension with the movement being limited by stops.

This possibility of the block fitting of the second auxiliary hoist rotating through approximately ±15° about the axis of the second cargo boom extension is advantageous when it is necessary for the two auxiliary hoists to pull at an angle to one another. On the other hand, it is also necessary to restrict the freedom of rotation in order to ensure that the second auxiliary hoist is also rotated into the other working region as the cargo boom is swung through the plane of the kingposts.

Finally, the second auxiliary hoist can operate independently of the first auxiliary hoist and, with appropriate dimensioning of the connection, can also operate simultaneously.

The invention will be described further below in more detail with reference to the attached drawings, in which:

FIG. 1. shows the lower portion of a cargo handling apparatus in accordance with the invention in the working position;

Figure 1:
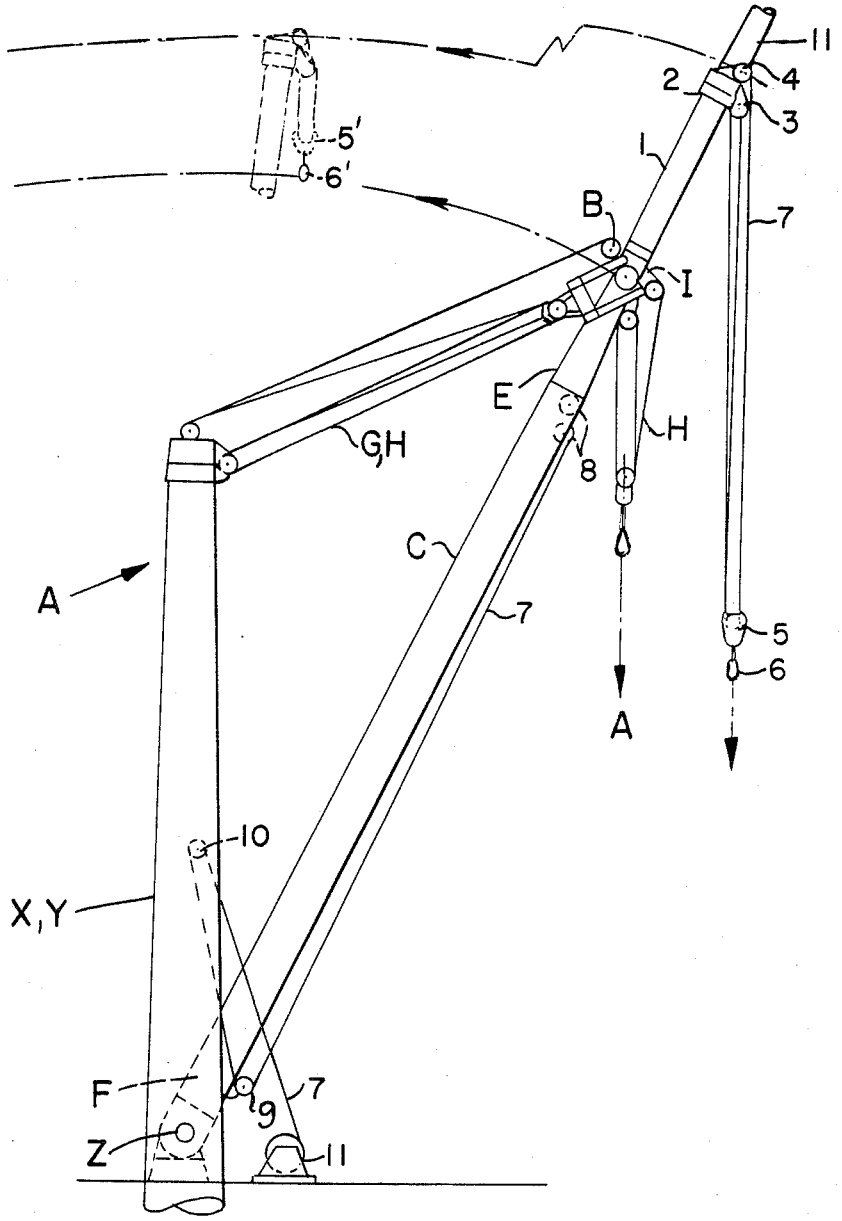

Referring now to the drawings in detail FIG. 1 shows a cargo handling apparatus A with a tubular extension 1 extending beyond a block fitting B of a main lift C. At the upper end of extension 1 there is arranged a block fitting 2 which is journalled on bearings so as to be rotatable with respect to the axis of the lift. Block fitting 2 carries one or more cable sheaves 3 and a guide sheave 4 for a cable or tackle 7 of an auxiliary lift.

The block fitting 2 of the auxiliary hoist which carries the upper cargo block and the guide pulley is rotatable about the axis of the cargo boom, and the guide pulley and the cable pulleys of the upper cargo block are arranged on the block fitting eccentrically of the axis of rotation thereof. The spacing of the block fitting of the auxiliary hoist from the fittings of the main hoist is at least sufficiently large that, with the lower cargo block and cargo hook of the auxiliary hoist moved into the raised position and with an approximately vertical position of the cargo boom, the lower edge of the cargo hook is free of the fittings of the main hoist.

Figure 2:
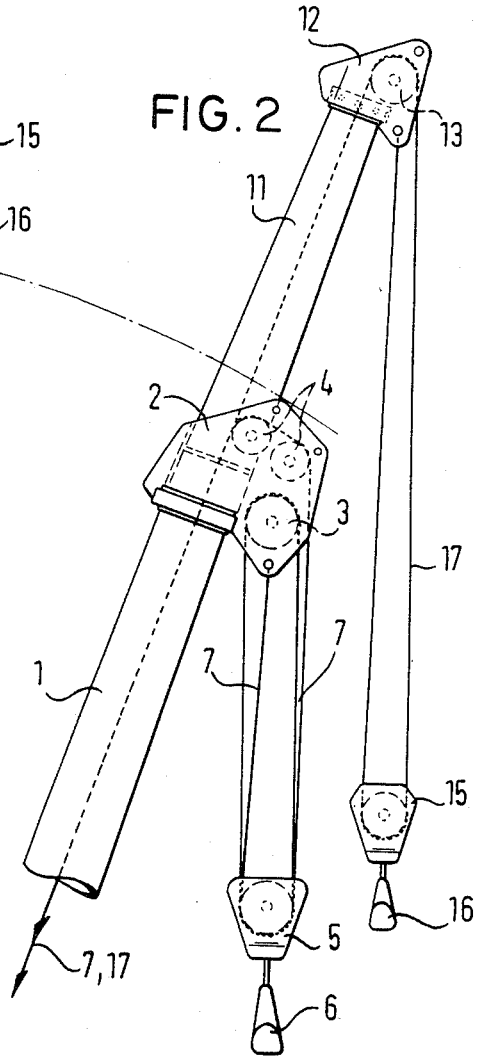
FIG. 2 shows the uppermost portion of the cargo handling apparatus in greater detail.

As indicated in the top portion of FIG. 1 and as shown in greater detail in FIG. 2 a second extension 11 of the cargo boom extends beyond the block fitting 2 of the first auxiliary hoist. Extension 11 carries a block fitting 12 with a cable pulley 13, a lower cargo block 15 and a load hook 16, suspended by a cable or tackle 17.

Figure 3:
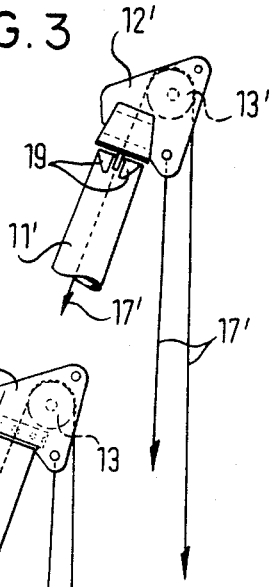
FIG. 3 shows another embodiment of the cargo handling apparatus of the cargo handling apparatus of FIGS. 1 and 2.

FIG. 3 shows a modified embodiment of the second auxiliary hoist of FIG. 2. Similar elements are designated with the same prime (') numerals. This embodiment is provided with stops 19 for limiting the rotational movement of the block fitting 12'.

Thus, the block fitting of the second auxiliary hoist is connected fixedly (in the embodiment of FIG. 2) or for only limited rotational movement (FIG. 3) by means of the second extension 11 of the cargo boom with the block fitting 2 of the second auxiliary hoist which is rotatable about the axis of the cargo boom. With the lower cargo block (15) and the cargo hook 16 moved into the raised position and an approximately vertical position of the cargo boom, the lower of the cargo hook 16 of the second auxiliary hoist is preferably free of the block fitting 2 of the first auxiliary hoist.

The block fitting (12') of the second auxiliary hoist can make restricted rotational movements through an angle of approximately ±15° about the axis of the second cargo boom extension 11', with the movement being limited by the stops 19.

The second auxiliary hoist may operate independently from the first auxiliary hoist and, with appropriate dimensioning of the connection, can also operate simultaneously.

Figure 4:
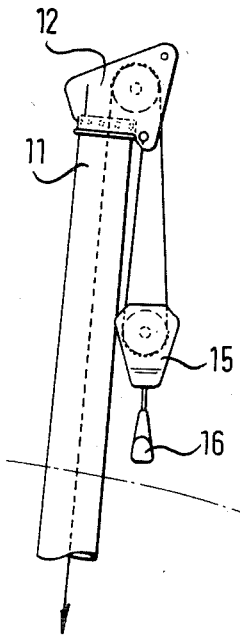
FIG. 4 shows the cargo handling apparatus of FIG. 1 in its uppermost vertical position.

Finally, FIG. 4 shows the top portion of FIG. 2 in its almost vertical position prior to passing through the plane of the kingposts X and Y.

I claim:

1. In a cargo handling apparatus comprising first and second kingposts arranged spaced apart from one another in a plane; a swivel bearing disposed between said kingposts; a cargo boom having upper and lower ends and pivotably mounted at its lower end on said swivel bearing; first and second span tackles extending between said upper end of said cargo boom and said first and second kingposts, said cargo boom being capable of being swung through said plane between said kingposts from a first working position on one side of said kingposts to a second working position on the other side of said kingposts; a main hoist carried by said cargo boom, said main hoist including main hoist fittings mounted on said cargo boom at its upper end; a first extension fixedly connected to the upper end of said cargo boom and projecting beyond said main hoist fittings and having a longitudinal axis and an upper end; a first auxiliary hoist carried by the upper end of said first extension, said first auxiliary hoist comprising a block fitting rotatable about said longitudinal axis of said first extension, an upper cargo block carried by said block fitting, a guide sheave and cable sheaves arranged on said upper cargo block eccentrically of said longitudinal axis, and a lower cargo block having a lower edge, said block fitting of said first auxiliary hoist being spaced from said main hoist fittings so that, in an approximately vertical position of said cargo boom and in a raised position of said auxiliary hoist said auxiliary hoist rotates about said first extension and said lower edge is free of said main hoist fittings: the improvement comprising: a second extension of said cargo boom, said second extension having upper and lower ends, the lower end of said second extension being fixedly connected to said block fitting of said first auxiliary hoist so as to be rotatable therewith about said axis; and a second auxiliary hoist carried by said upper end of said second extension, said second auxiliary hoist comprising a block fitting and upper and lower cargo blocks, said lower cargo block of said second auxiliary hoist having a lower edge; in a raised position of said lower cargo block of said second auxiliary hoist adjacent said upper cargo block of said second auxiliary hoist and in an approximately vertical position of said cargo boom, said lower edge of said lower cargo block of said second auxiliary hoist being free of the block fitting of said first auxiliary hoist, whereby said block fitting of said second auxiliary hoist is rotated with said block fitting of said first auxiliary hoist around said cargo boom when said cargo boom is swung through said plane from one of said working positions to the other said block fitting of said second auxiliary hoist being rotatably connected to said upper end of said second extension for restricted angular rotating movement around said second extension and stoppers mounted on said second extension to restrict said rotating movement.

2. Cargo handling apparatus in accordance with claim 1 wherein said block fitting of said second auxiliary hoist is fixedly connected to said upper end of said second extension.

3. Cargo handling apparatus in accordance with claim 1 wherein said movement is restricted to ±15° around said second extension.

* * * * *